US006571422B1

(12) United States Patent
Gordon et al.

(10) Patent No.: US 6,571,422 B1
(45) Date of Patent: Jun. 3, 2003

(54) VACUUM CLEANER WITH A MICROPROCESSOR-BASED DIRT DETECTION CIRCUIT

(75) Inventors: Evan A. Gordon, North Canton, OH (US); Jay M. Salem, Akron, OH (US)

(73) Assignee: The Hoover Company, North Canton, OH (US)

( * ) Notice: Subject to any disclaimer, the term of this patent is extended or adjusted under 35 U.S.C. 154(b) by 56 days.

(21) Appl. No.: 09/630,695

(22) Filed: Aug. 1, 2000

(51) Int. Cl.[7] ..... A47L 9/28
(52) U.S. Cl. ..... 15/339
(58) Field of Search ..... 15/319, 339

(56) References Cited

U.S. PATENT DOCUMENTS

| | | | | |
|---|---|---|---|---|
| 2,045,496 A | | 7/1936 | Skinner | |
| 2,203,171 A | | 6/1940 | Martinet | |
| 2,715,946 A | | 8/1955 | Peterson | |
| 3,674,316 A | | 7/1972 | Debrey | |
| 3,989,311 A | | 11/1976 | Debrey | |
| 4,099,861 A | | 7/1978 | Abel | |
| 4,175,892 A | | 11/1979 | Debrey | |
| 4,199,838 A | | 4/1980 | Simonsson | |
| 4,294,595 A | | 10/1981 | Bowerman | |
| 4,342,133 A | | 8/1982 | Minton | |
| 4,580,311 A | | 4/1986 | Kurz | |
| 4,601,082 A | | 7/1986 | Kurz | |
| 4,733,430 A | | 3/1988 | Westergren | |
| 4,733,431 A | | 3/1988 | Martin | |
| 4,767,213 A | | 8/1988 | Hummel | |
| 5,023,973 A | | 6/1991 | Tsuchida et al. | |
| 5,136,750 A | * | 8/1992 | Takashima et al. | 15/319 |
| 5,507,067 A | * | 4/1996 | Hoekstra et al. | 15/319 |
| 5,608,944 A | | 3/1997 | Gordon | |
| 5,850,665 A | * | 12/1998 | Bousset | 15/319 |
| 6,023,814 A | * | 2/2000 | Imamura | 15/339 |
| 6,026,539 A | | 2/2000 | Mouw et al. | |
| 6,029,309 A | * | 2/2000 | Imamura | 15/319 |
| 6,055,702 A | * | 5/2000 | Imamura et al. | 15/339 |

FOREIGN PATENT DOCUMENTS

| | | |
|---|---|---|
| DE | 2336758 | 3/1974 |
| DE | 3431175 | 9/1986 |
| DE | 4323222 | 7/1993 |
| EP | 231419 | 8/1987 |
| EP | 365191 | 4/1990 |
| EP | 371632 | 6/1990 |
| EP | 366295 | 9/1993 |
| ES | 2072472 | 4/1990 |
| GB | 2228353 | 2/1989 |
| GB | 2225220 | 8/1992 |
| GB | 2225933 | 9/1992 |
| KR | 9308368 | 6/1991 |

* cited by examiner

*Primary Examiner*—Chris K. Moore
(74) *Attorney, Agent, or Firm*—A. Burgess Lowe; Michael J. Corrigan

(57) ABSTRACT

A vacuum cleaner for providing visual operational status indicators includes a vacuum cleaner having internal components that are indicative of the cleaner's performance. Sensors are coupled to at least one of the internal components to be monitored. A microprocessor receives input from the sensors, analyzes the input, and generates an output signal. Visual indicators are carried by the vacuum cleaner and receive the output signals to display the operational status of the vacuum.

29 Claims, 9 Drawing Sheets

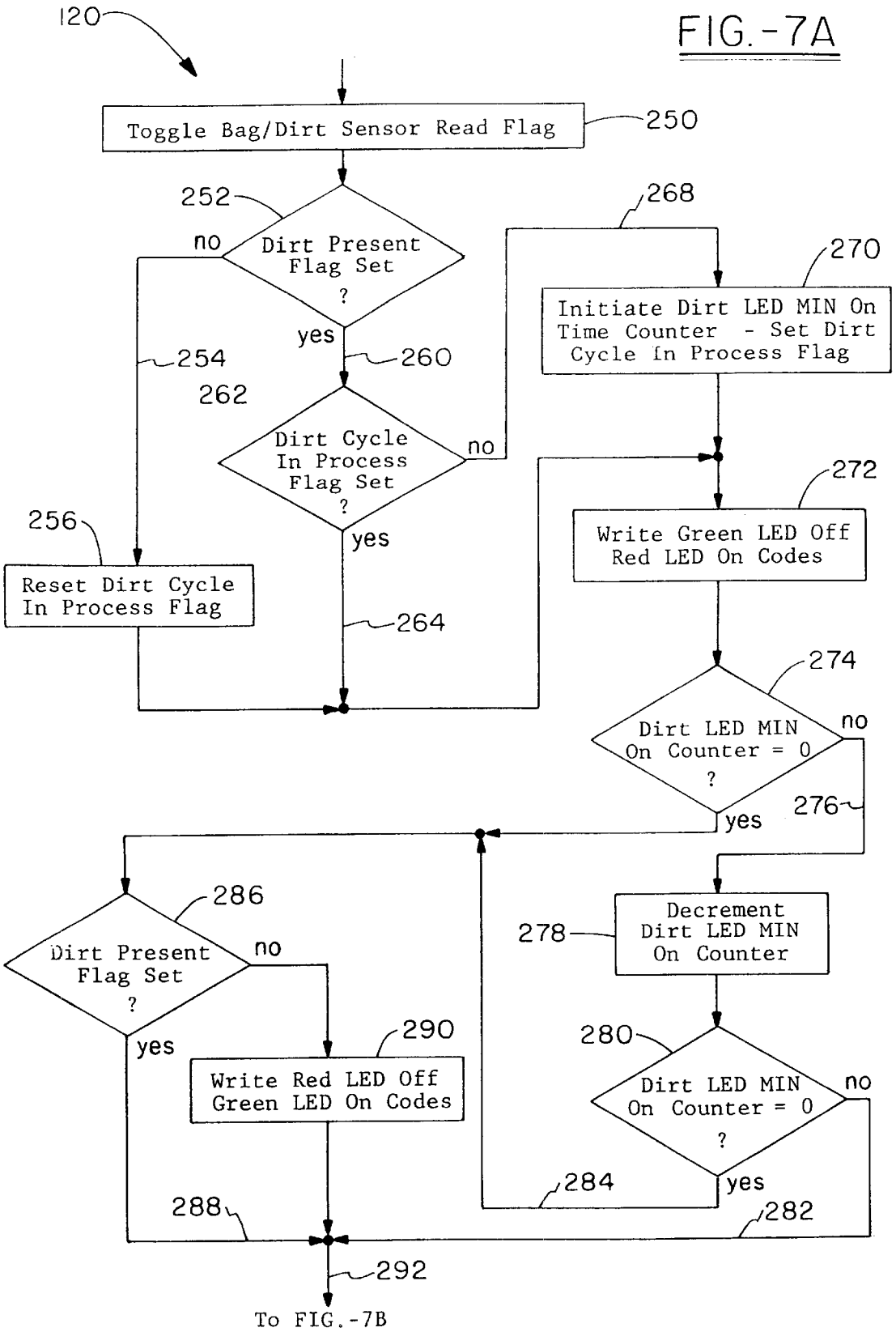
120
FIG.-7A
Toggle Bag/Dirt Sensor Read Flag
250
252
Dirt Present Flag Set ?
no
yes
254
260
262
Dirt Cycle In Process Flag Set ?
no
yes
264
256
Reset Dirt Cycle In Process Flag
268
270
Initiate Dirt LED MIN On Time Counter - Set Dirt Cycle In Process Flag
272
Write Green LED Off Red LED On Codes
274
Dirt LED MIN On Counter = 0 ?
no
yes
276
278
Decrement Dirt LED MIN On Counter
280
Dirt LED MIN On Counter = 0 ?
no
yes
284
282
286
Dirt Present Flag Set ?
no
yes
290
Write Red LED Off Green LED On Codes
288
292
To FIG.-7B

VACUUM CLEANER WITH A MICROPROCESSOR-BASED DIRT DETECTION CIRCUIT

TECHNICAL FIELD

This invention r elates to vacuum cleaners with a n operational output display More particularly, this invention relates to a vacuum cleaner with electronic circuitry that monitors at least the amount of dirt collected at a given time or the level of t he dirt contained Within a filter bag. Specifically, the present invention relates to sensors for monitoring operational parameters of the vacuum cleaner that generate input that is monitored and acted upon by a microprocessor.

BACKGROUND ART

As disclosed in U.S. Pat. No. 5,608,944, which is incorporated herein by reference, it is known to provide electronic circuitry to monitor the amount of dirt suctioned from a surface being cleaned and to monitor the level of dirt contained within a filter or holding bag. Although this patent discloses a device that is effective in its stated purpose, it has been found that the circuitry is problematic and not easily adapted to other models of vacuum cleaners. Such circuitry is subject to false readings and must be changed for any revisions to the structural features of the vacuum into which it is installed. For example, if the power of the motor used to suction dirt off of a surface is changed, changes are required to the settings which trigger upon the amount of dirt flowing through the vacuum cleaner's airducts. As a result, each time a new vacuum cleaner model is introduced, a new circuit must be designed. This results in high engineering and development costs.

Therefore, there is a need in the art for a vacuum cleaner with a dirt detection circuit that is easily adapted to various models and which allows for receipt of additional inputs for displaying the operational status of the vacuum cleaner.

DISCLOSURE OF INVENTION

It is thus an object of the present invention to provide a vacuum cleaner with a microprocessor-based dirt detection circuit.

It is another object of the present invention to provide a vacuum cleaner, as above, in which the internal components of the vacuum cleaner, such as a fan/motor assembly, air duct tubes, and filter bags, are monitored along with other internal components of the vacuum cleaner by sensors for the purpose of displaying the cleaner's operational status.

It is a further object of the present invention to provide a vacuum cleaner, as above, which includes a circuit with a microprocessor, wherein the microprocessor receives input from the sensors coupled to the various internal components of the vacuum cleaner for monitoring.

It is another object of the present invention for the microprocessor to generate signals that illuminate visual outputs for the benefit of the vacuum cleaner's user.

It is yet another object of the present invention to provide a vacuum cleaner, as above, which includes a microphone for monitoring dirt as it travels through an air duct to the filter bag, wherein the processor compares a signal generated by a microphone to a threshold value and then, depending upon the comparison, increments or decrements a pair of counters, wherein one counter is initially set to a minimum value and the other counter is set to a maximum value.

It is yet another object of the present invention to provide a vacuum cleaner, as above, wherein the microprocessor increments and decrements the pair of counters based upon the microphone sensor's input in such a manner that a selected number of repeated readings of dirt flowing through the duct are required to illuminate a red light indicative of a dirty surface.

It is still another object of the present invention to provide a vacuum cleaner, as above, that includes a green light that, when illuminated, is indicative of the microprocessor detecting an amount of dirt below a predetermined threshold flowing through the air duct.

It is still a further object of the present invention to provide a vacuum cleaner, as above, in which a pressure transducer monitors the fill level of the filter bag and inputs this value to the microprocessor.

It is an additional object of the present invention to provide a vacuum cleaner, as above, which includes a counter contained within the microprocessor to ensure that successive readings of the pressure transducer above a threshold value are required to indicate that the filter bag is full. It is another object of the invention that when such a determination is made, the microprocessor outputs a signal to illuminate a light of different color than the other operational parameters.

The foregoing and other objects of the present invention, which shall become apparent as the detailed description proceeds, are achieved by a vacuum cleaner for providing visual operational status indicators, comprising a vacuum cleaner having internal components, at least one sensor coupled to at least one of the internal components, a microprocessor for receiving input from at least one sensor, analyzing the input, and generating an output signal, and a visual indicator carried by the vacuum cleaner for receiving the output signal to display the operational status of the internal component.

Other aspects of the present invention are attained by a cleaner having operational indicators, comprising a motor/fan assembly for suctioning dirt from a surface, a tube coupled at one end to the motor/fan assembly, a bag coupled to the tube collecting the dirt suctioned by the motor/fan assembly, a sensor associated with the tube to monitor the amount of dirt passing therethrough, the sensor generating an input signal, and a microprocessor for receiving and comparing the input signal to a threshold value and generating an output signals value.

Still another object of the present invention is attained by a cleaner having operational indicators, comprising a motor/fan assembly for suctioning dirt from a surface, a tube coupled at one end to the motor/fan assembly, a bag coupled to the tube collecting the dirt suctioned by the motor/fan assembly, a sensor associated with the bag to monitor the amount of dirt therein, the sensor generating an input signal, a microprocessor for receiving and comparing the input signal to a threshold value and generating an output signal, and a light illuminated depending upon the output signal's value.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein:

FIGS. 7A–B are the operational flowcharts employed by the microprocessor for analyzing the output codes generated in FIGS. 5 and 6 and for providing the codes to illuminate the visual indicators of the present invention.

Similar numerals refer to similar parts throughout the drawings.

BEST MODE FOR CARRYING OUT THE INVENTION

Figure 1:
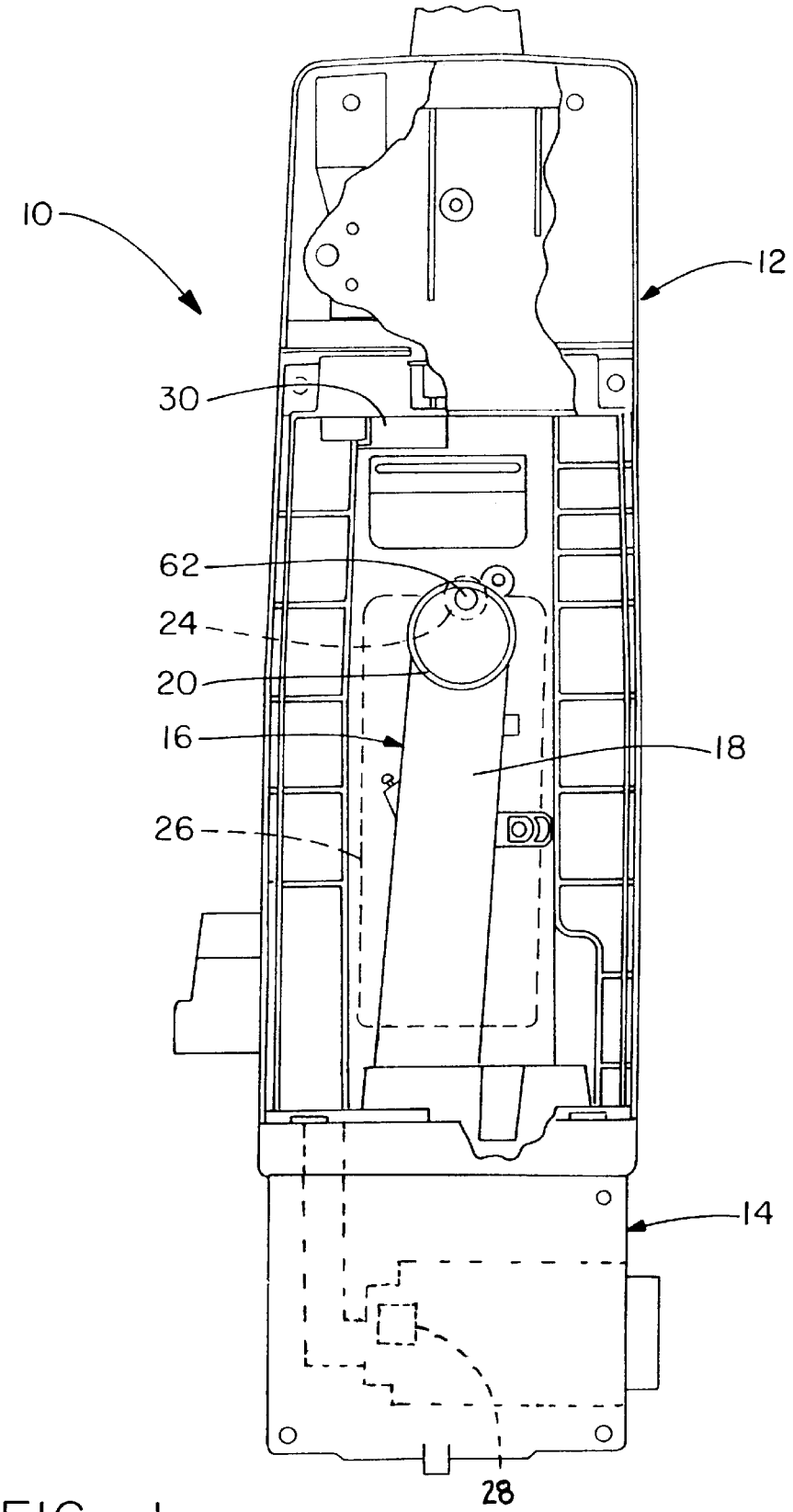
FIG. 1 is an elevational view of a cleaner housing of a vacuum cleaner with a hard back cover removed and which mountingly incorporates the invention.

Referring now to the drawings and, more particularly, to FIG. 1, a vacuum cleaner with a microprocessor-based dirt detection circuit according to the present invention is generally designated by the numeral 10. Vacuum cleaner 10 may be of the direct air type wherein the motor-fan assembly is positioned upstream of the dirt separating arrangement (such as a filter bag or dirt cup) of the vacuum cleaner, or of the indirect air type wherein the motor-fan assembly is positioned downstream of the dirt separating arrangement of the vacuum cleaner. Generally, the vacuum cleaner 10 selectively illuminates lights depending upon its operational status. These lights indicate to the user of the vacuum cleaner pertinent information such as whether dirt is being suctioned up by the vacuum cleaner or whether the fill level of the bag collecting the dirt is full or almost full. It is envisioned that the present invention could use other sensors to monitor and display other operational parameters of the vacuum cleaner such as carpet height, percentage content of the dirt being collected, the operational status of the motor, the operational status, various filters, and the like. The present invention is adaptable to most any type of vacuum cleaner or cleaning device in which dirt or other matter is suctioned from a surface.

The vacuum 10 includes a housing 12 which carries the internal components of the vacuum cleaner. These components may include a motor/fan assembly housing 14 which is coupled to an upper fill tube designated generally by the numeral 16. The tube 16 includes an upper duct 18 which has a right-angle bend 20. A boss 24 is provided in the area of the bend 20 for a purpose to be described in detail below. A filter bag, designated generally by the numeral 26, is connected to the right-angle bend 20 for the purpose of storing dirt or other matter suctioned into the tube 16 by the motor/fan assembly 14. It is understood that although vacuum cleaner 10 is shown and described herein as having vacuum cleaner filter bag 26, vacuum cleaner 10 could include various other dirt collection containers such as a dirt cup which is housed within housing 12. Bagless vacuum cleaners having a dirt cup are well known in the art and utilize a filter assembly or a cyclonic action within the dirt cup to separate the dirt particles from the incoming air stream. For simplicity and convenience, filter bag 26 and any alternative dirt collection containers will be commonly referred to as filter bag 26.

A sensor 28 is connected somewhere in the vicinity of the bag 26 and is strategically positioned to effectively monitor the operational status of the filter bag. In one embodiment of the invention, the bag sensor 28 is positioned within the motor-fan assembly housing 14 adjacent to the motor-fan eye, however it is understood that the bag sensor 28 could be located anywhere within the airflow produced by the motor-fan assembly, such as within a duct or within housing 12, without affecting the concept of the invention. The housing 12 also provides a circuit housing 30 to carry the discrete electronics which are used to receive inputs from the sensors and monitor the operational status of the vacuum cleaner.

Figure 2:
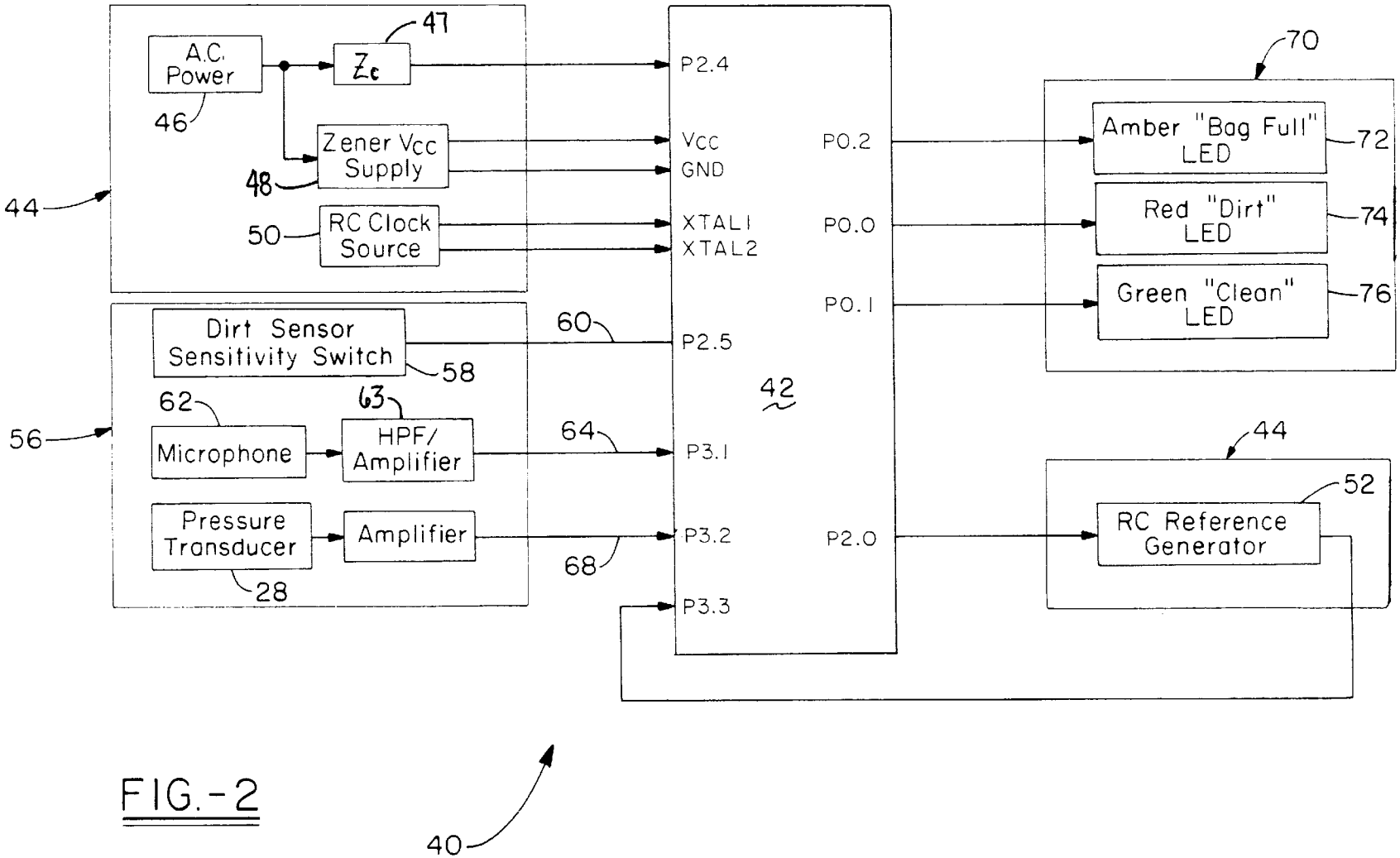
FIG. 2 is a schematic of a microprocessor-based circuit according to the concepts of the present invention.
Figure 3:
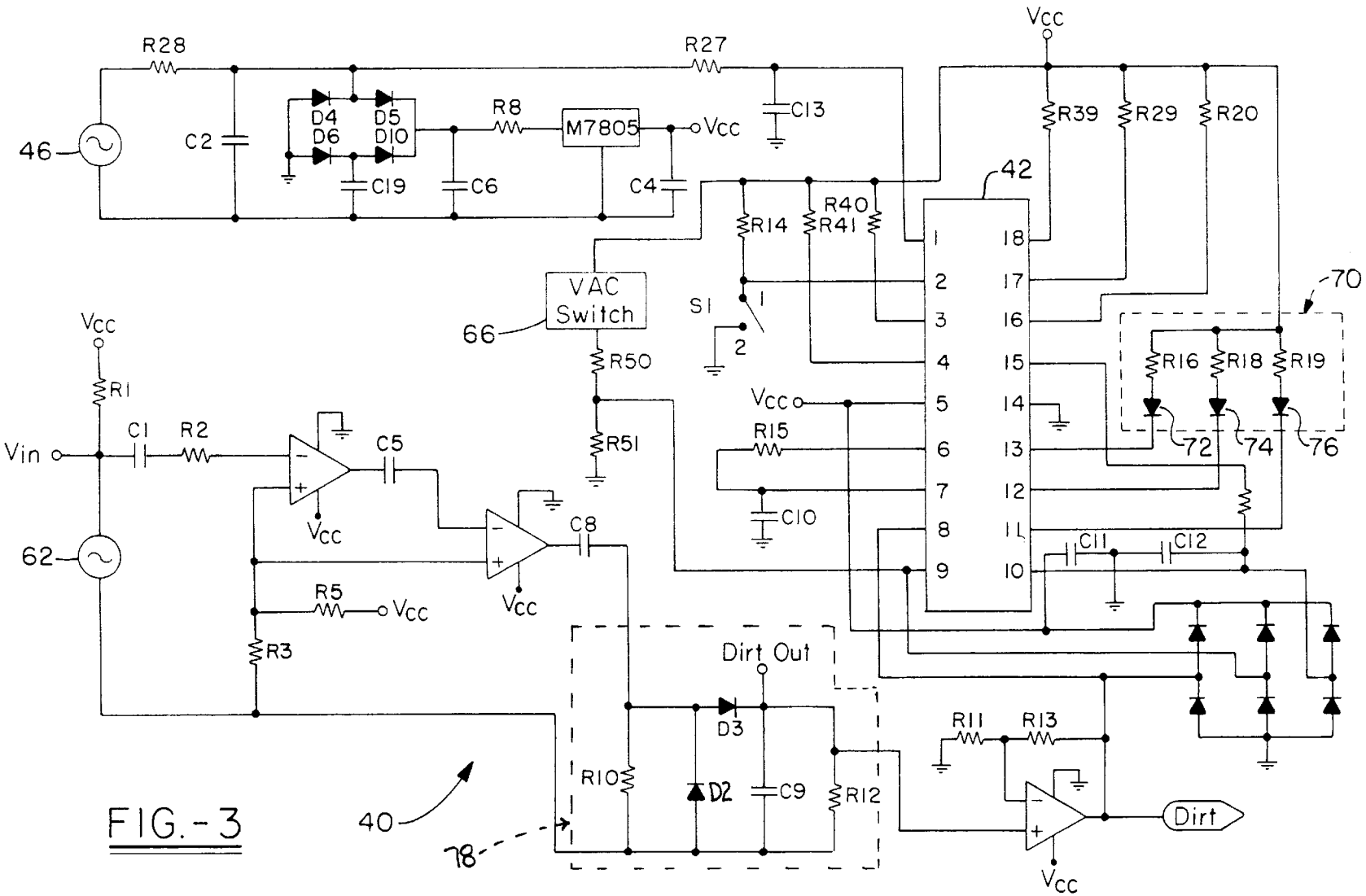
FIG. 3 is an electrical circuit schematic showing the discrete components of the circuit employed in the present invention.

Referring now to FIGS. 2 and 3, it can be seen that a detection circuit, designated generally by the numeral 40, is employed to implement the objects and features of the present invention. As will be appreciated by those skilled in the art, the detection circuit 40 is carried in the circuit housing 30 shown in FIG. 1. The detection circuit 40 includes a microprocessor 42 for implementing the various objects of the present invention. The microprocessor 42 contains the necessary hardware, software, and memory for implementing the various objects of the present invention. In the preferred embodiment, the microprocessor is identified as ZiLOG Z86E02. Of course, other microprocessors may be employed for carrying out the concepts of the present invention. The microprocessor 42 receives various operational inputs designated generally by the numeral 44. These inputs include, but are not limited to, AC Power 46 which is monitored such that the other operational inputs are detected and processed according to a zero crossing of the alternating current that powers the cleaner. A zero crossing circuit 47 is positioned between AC power 46 and the microprocessor 42. Input 44 further includes a voltage supply 48 that is employed to power the discrete electrical components of the detection circuit 40. An RC Clock 50 and an RC Reference Generator 52 are also input to the microprocessor in a manner well known in the art.

A plurality of sensor inputs are designated generally by the numeral 56. Although specific inputs are discussed herein, it will be appreciated that additional inputs may be provided to the microprocessor 42 for evaluation and preparation of signals to advise the vacuum cleaner user of the operational status of the cleaner. In the present embodiment, the sensor inputs 56 include a sensitivity switch 58 which generates a signal 60 received by the processor 42. A microphone 62, which is carried in the boss 24 shown in FIG. 1, is utilized to detect audible noises generated by dirt passing through the upper duct 18 and the bend 20. The audio signal detected by microphone 62 is amplified by HPF/Amplifier circuit 63 and is then transmitted to the microprocessor 42 in the form of a signal 64. A VAC switch 66 provides a signal to the microprocessor 42 via a voltage divider created by resistors R50 and R51. It will be appreciated that as more dirt passes through the duct, more noise is generated and, as such, is indicative of a dirty cleaning surface. As the vacuum removes the dirt or other matter, the noise of particles passing through the duct 18 decreases and the signal 64 generated by the microphone 62 also decreases. The bag sensor 28 is represented in FIG. 2 as a pressure transducer which generates a signal 68 corresponding to the condition of filter bag 26. It is understood that although bag sensor 28 is shown in FIG. 2 as a pressure transducer, bag sensor 28 may also be a diaphragm or pressure switch as well as any other type of sensor suitable to detect pressure differentials. The signals 64 and 68 may be amplified as needed for proper processing by the processor 42. The pressure signal 68 is indicative of the fill level of dirt or other matter contained within the bag 26.

The microprocessor 42 processes the input signals 60, 64, and 68 to generate outputs designated generally by the numeral 70. The display outputs 70 include a "bag full" LED 72 which, in the preferred embodiment, is amber in color. A "dirt" LED 74, which is preferably red, indicates when the microphone detects excessive amounts of dirt traveling through the duct, and a "clean" LED 76, which is preferably green, is indicative of when the microphone no longer detects a threshold level of dirt traveling through the duct.

The microprocessor 42 selectively illuminates the green and red lights to indicate when the cleaner is or is not picking up dirt from the floor or other surface being cleaned. When the microphone 62 detects the presence of dirt above a predetermined threshold, the microprocessor illuminates the red LED 74 which indicates to the user that the area being cleaned is still dirty and that the user should continue to clean in that area. Once the microphone 62 no longer detects the presence of dirt, the microprocessor turns off the red LED 74 and turns on the green LED 76. This indicates to the user that the area is clean and that the vacuum cleaner can be moved to a new area.

With continued reference to FIG. 3, the detection circuit 40 includes a diode pump indicated generally at 78. Diode pump 78 includes a resistor R10, a diode D2, a capacitor C9 and a second resistor R12 all connected in parallel. A second diode D3 is positioned in series between the first diode D2 and the capacitor C9. Diode pump 78 receives the AC audio signal from microphone 62 after the signal has been amplified by HPF/Amplifier circuit 63. Diode pump 78 serves to filter the AC audio signal from microphone 62 and converts the signal to a DC value. The converted DC signal is amplified to a readable level prior to being input into microprocessor 42.

The microprocessor 42 allows for easy adjustment of the system's operating parameters for different cleaners and provides the flexibility of being able to add new functions without having to completely redesign the associated circuit. The consumer can adjust the sensitivity of the dirt sensor by placing the sensitivity switch. 58 into either a high or low sensitivity setting. The sensitivity switch 58 selects one of two threshold values programmed into the microprocessor 42 at the time of manufacture.

The microphone 62 is used to detect sound created in the duct 18 by dirt passing therethrough. The analog DC voltage output generated by the microphone is converted to a digital signal and the microprocessor determines a mean value of the DC voltage and compares the mean value with the selected threshold value. The microprocessor 42 is programmed so that the red LED 74 remains on or for a predetermined period of time and will only turn the red LED off and turn the green LED on after the input from the microphone 62 drops below the threshold value for another selected period of time. This delay feature eliminates distracting flickering between the red and green lights.

The pressure transducer 28 is positioned near the suction side of the fan in the housing to sense the pressure of the housing between the filter bag and the fan. The output of the pressure transducer 28 is then input into the microprocessor 42. As the filter bag 26 fills, the pressure in the housing drops as the full bag restricts airflow through the housing. This increase in negative pressure within the housing is detected by the transducer. When the suction or negative pressure increases to a predetermined level, the microprocessor 42 turns on the amber LED to indicate that the filter bag 26 needs to be checked. Microprocessor 42 provides the additional flexibility of flashing any of the lights to create a more visually noticeable indicator. In the present embodiment, the microprocessor is programmed to flash the amber "bag full" LED on and off to visually alert the user of a full bag condition.

The foregoing operational inputs to the processor 42 are timed according to the AC waveform from the wall outlet into the vacuum cleaner. For example, at the first zero crossing, the condition of the sensitivity switch 58 is checked. On the next zero crossing, the output from the microphone is checked by the microprocessor and on the next zero crossing, the output from the pressure transducer is checked. It will be appreciated that other inputs may be checked upon subsequent zero crossings of the AC wave.

FIG. 3 of the drawings shows the discrete electrical components of the invention to provide a complete enablement of the circuit 40 and its operation. It will be appreciated that the discrete components and their values may be adjusted according to the operational inputs and outputs associated with the microprocessor 42.

Figure 4:
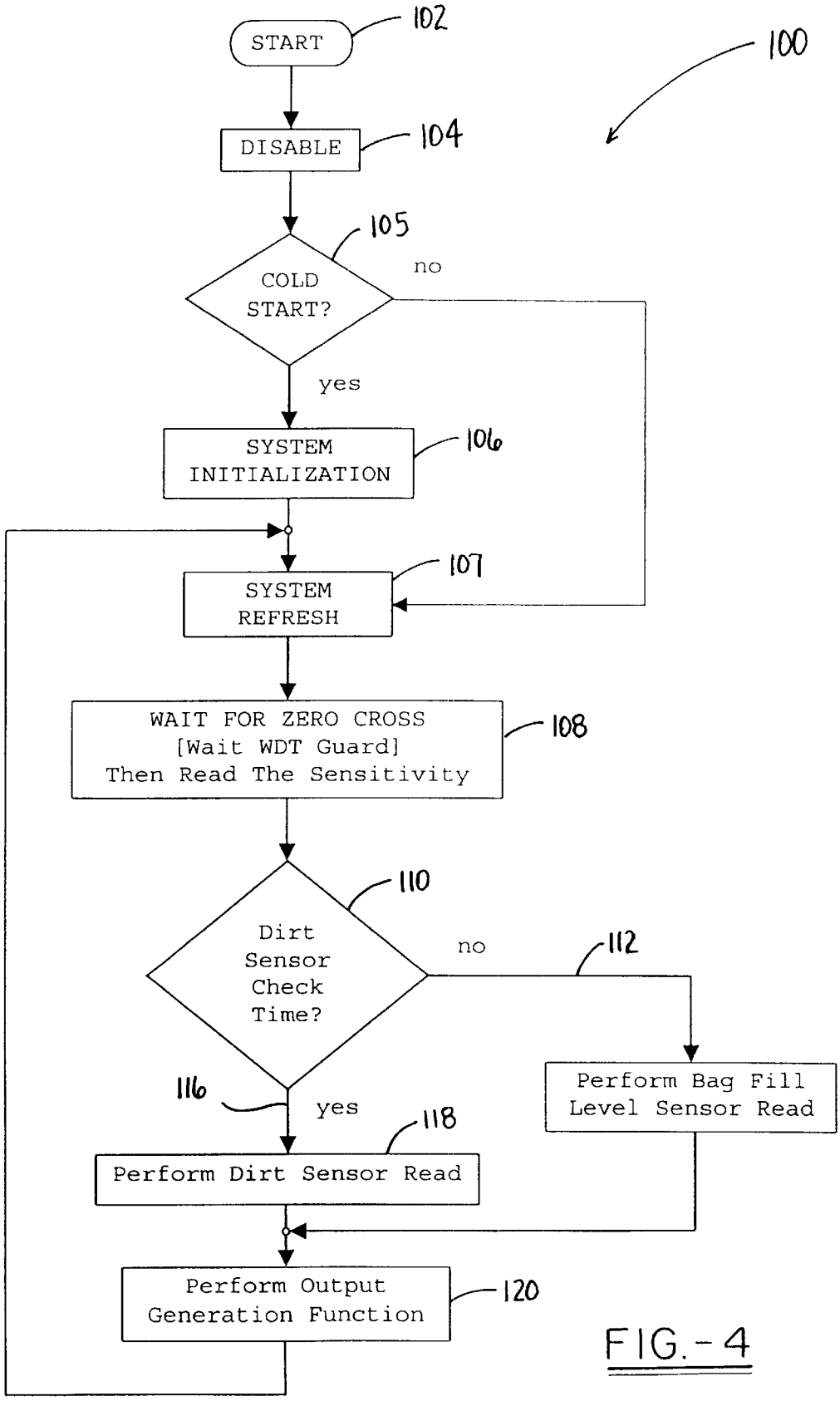
FIG. 4 is a top-level flowchart of the circuit's operation according to the present invention.

The processor 42 has a general operational flow as best seen in FIG. 4. The operational flow, which is designated generally by the numeral 100, starts at step 102 typically by turning on a power switch associated with the internal components of the vacuum cleaner. It should be noted that the program will also return to the startup step 102 in the event of a fatal error caused by a static discharge to the circuitry, for example. It is commonly known that friction on a carpeted surface causes a static electricity build up. When a person comes into contact with a metal portion of the vacuum cleaner, this build-up will discharge through the vacuum cleaner causing a fatal error in the microprocessor. Although the microprocessor is able to retain most of its stored memory, the program resets itself by returning to the start-up step 102.

At start-up, the processor 42 undergoes a disabling of all initiators, counters, and registers at step 104. This effectively clears any data retained within the memory of the microprocessor that is unneeded or distorts the start-up of the operational status of the vacuum cleaner. The processor then checks several memory locations and at step 105 determines whether this pass through the program is a cold start, that is, whether the program is starting from a power "on" condition or a fatal error condition. If the pass is a cold start, which indicates an initial power "on" condition, the program initializes the system at step 106 by illuminating all three LEDs, clearing various program registers and loading initialization data. If the pass is not a cold start, the program recognizes that it has already been powered on and will by pass the system initialization step 106 and jump directly to the system refresh 107.

At step 107, the microprocessor undergoes a system refresh to set the counter levels to their proper values for operation of the circuit 40. At step 108, the microprocessor waits for a zero crossing with an appropriate watchdog timer guard and then reads the sensitivity switch 58 for a purpose which will be described below. Next, at step 110, the processor determines whether the dirt sensor microphone 62 is required to be checked at the present time. If not, the flowchart proceeds along a path 112 to perform the bag fill level sensor reading operation at step 114. Alternatively, if at step 110, the dirt sensor check time is at the appropriate zero crossing, then the flowchart proceeds along a path 116 to perform the reading of the dirt sensor microphone 62 at step 118. Once this step is complete, the microprocessor 42 performs an output generation function 120.

Figure 5A:
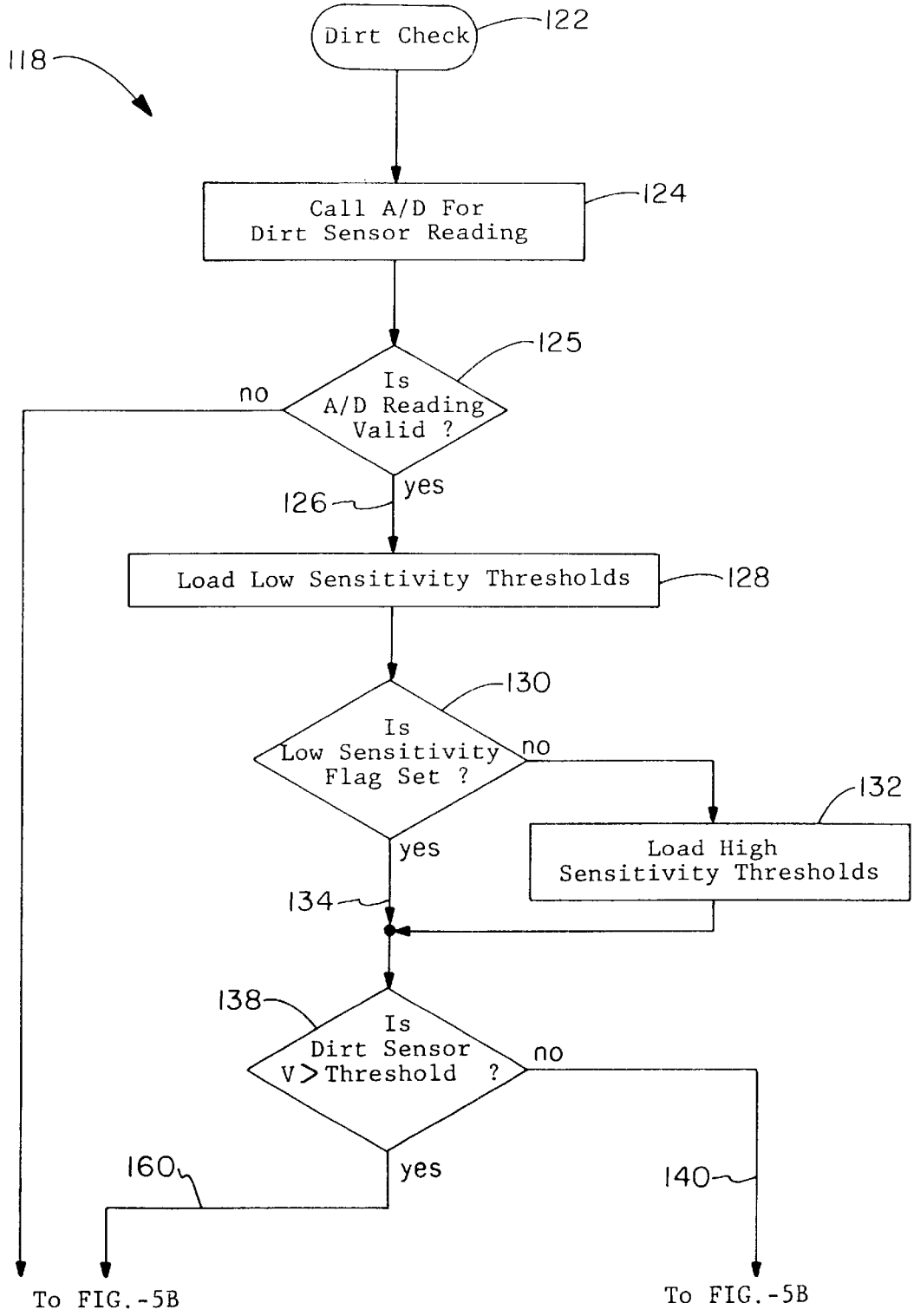
FIG. 5 is a flowchart of the processing routine employed by the microprocessor to check for dirt flowing through the vacuum cleaner.
Figure 5B:
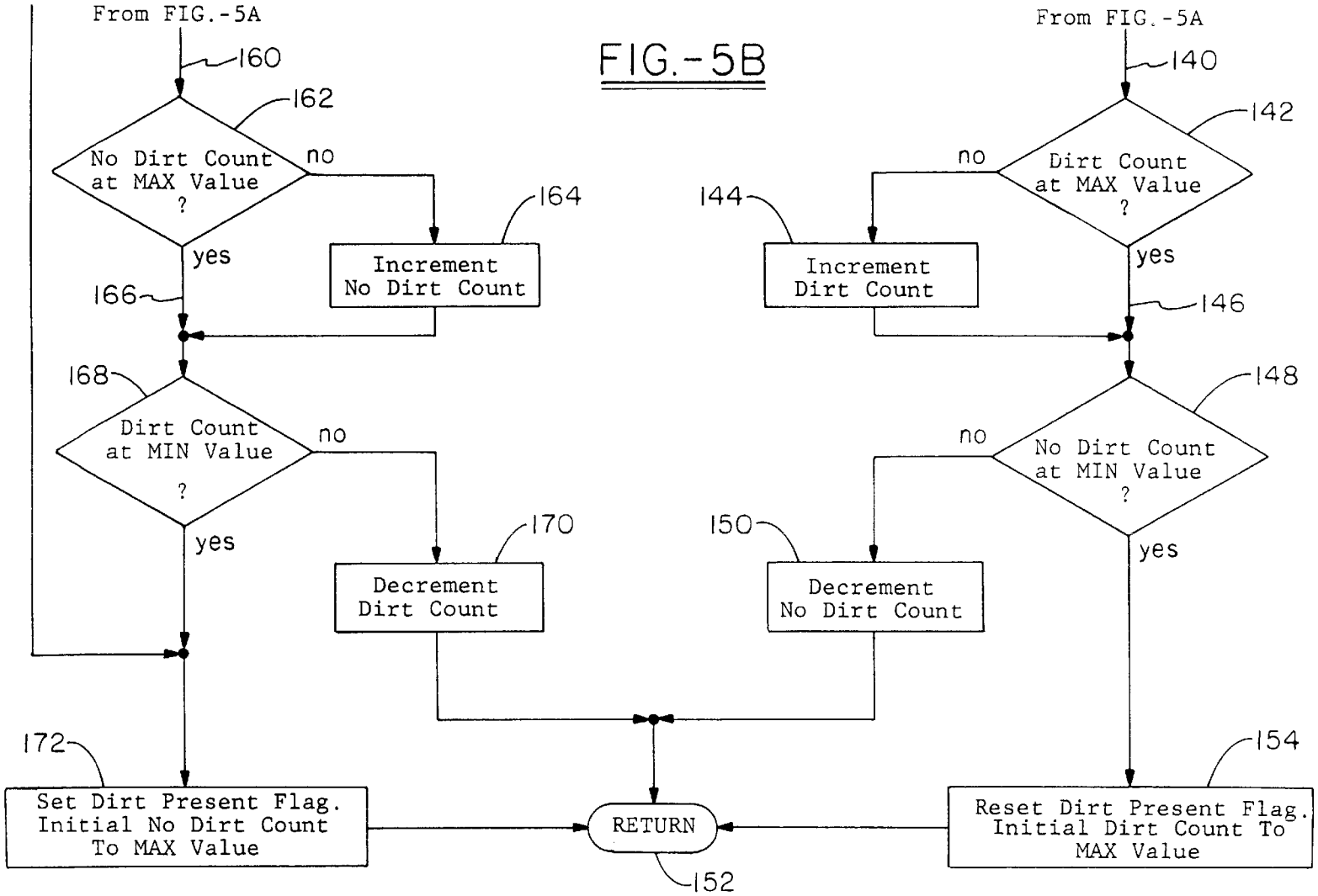

Referring now to FIG. 5, specific operation of the dirt checking subroutine 118 is shown. At step 122, the dirt checking subroutine is initiated. At step 124, the microprocessor follows an analog-to-digital routine for reading of the dirt sensor microphone signal 64. Step 125 determines if the analog-to-digital reading is valid, and if so, the flow proceeds along path 126 and the low sensitivity thresholds are entered into the appropriate counters at step 128. Next, at step 130, the microprocessor determines whether the low sensitivity flag has been set. This is done by detecting the switch position of the sensitivity switch 58 and a proper reading of the signal 60. If the low sensitivity flag has not been set, then at step 132, the processor loads the high sensitivity thresholds. Accordingly, the process returns to the path 134 and at step 138 determines whether the detected dirt sensor value is greater than the loaded threshold value.

Generally, the microprocessor 42 employs two counters, wherein a "no dirt counter" is set to a maximum value and a "dirt counter" is set to a minimum value. Based upon a determination of the sensor value at step 138, the flow proceeds through two branches. These branches, depending on whether the dirt level threshold value is exceeded or not, are employed to adjust the counters by either incrementing or decrementing their respective values. Once the appropriate levels are reached for either of the counters, a flag is set or reset for evaluation by the output generation function of the microprocessor.

At step 138, if the dirt sensor value is not greater than the threshold value, a path 140 (continued on FIG. 5B) leads to an evaluation of whether the dirt counter is at a maximum value at step 142. If the dirt counter is not at a maximum value, then at step 144, the dirt counter is incremented. If the dirt counter is at the maximum value, the flowchart proceeds through path 146 and, at step 148, it is determined whether the "no dirt counter" is at a minimum value. If the no dirt counter is not at a minimum value, then at step 150, the no dirt counter is decremented and the process returns to the main operational flow of the microprocessor as represented at step 152. However, if at step 148, it is determined that the no dirt counter is at a minimum value, then at step 154, a "dirt present flag" is reset and the dirt counter is initialized to a maximum value, whereupon at step 152, the process returns to the general operational flow of the device.

If at step 138, it is determined that the dirt sensor value is greater than the threshold value, the flowchart proceeds along a path 160 to a determination as to whether the no dirt counter is at a maximum value, at step 162. If the no dirt counter is not at a maximum value, then at step 164, the no dirt counter is incremented. However, if it is determined that the no dirt counter is at a maximum value, then the process follows path 166 and determines whether the dirt counter is at a minimum value at step 168. If the dirt counter is not at a minimum value, then at step 170, the dirt counter is decremented and the process returns to the main process at step 152. If at step 168, it is determined that the dirt counter is at a minimum value, then the flowchart proceeds to step 172. At step 172, the processor sets the dirt present flag and initializes the no dirt counter to a maximum value and then proceeds to return to the operational flowchart at step 152. It should also be noted that if at step 125, the analog-to-digital reading is invalid, then the process proceeds to step 172.

It will be appreciated that at step 138, the two counters are inversely related to one another. In other words, as one counter is increased, and if the other counter is not at a minimum value, the other counter is decreased. This functions to ensure that multiple readings of a dirt level are at a value greater than the threshold for the dirt present flag to be set. If the dirt sensor is not read at the greater than value a repeated number of times, then the no dirt counter is correspondingly decremented. This functions to ensure that the red and green lights do not flicker, which may give a false impression to the user that an area of the surface being cleaned is clean when it is not. The values of the counters are set by the load sensitivity thresholds which are programmed into the microprocessor. These values are set according to the vacuum cleaner model.

Figure 6:
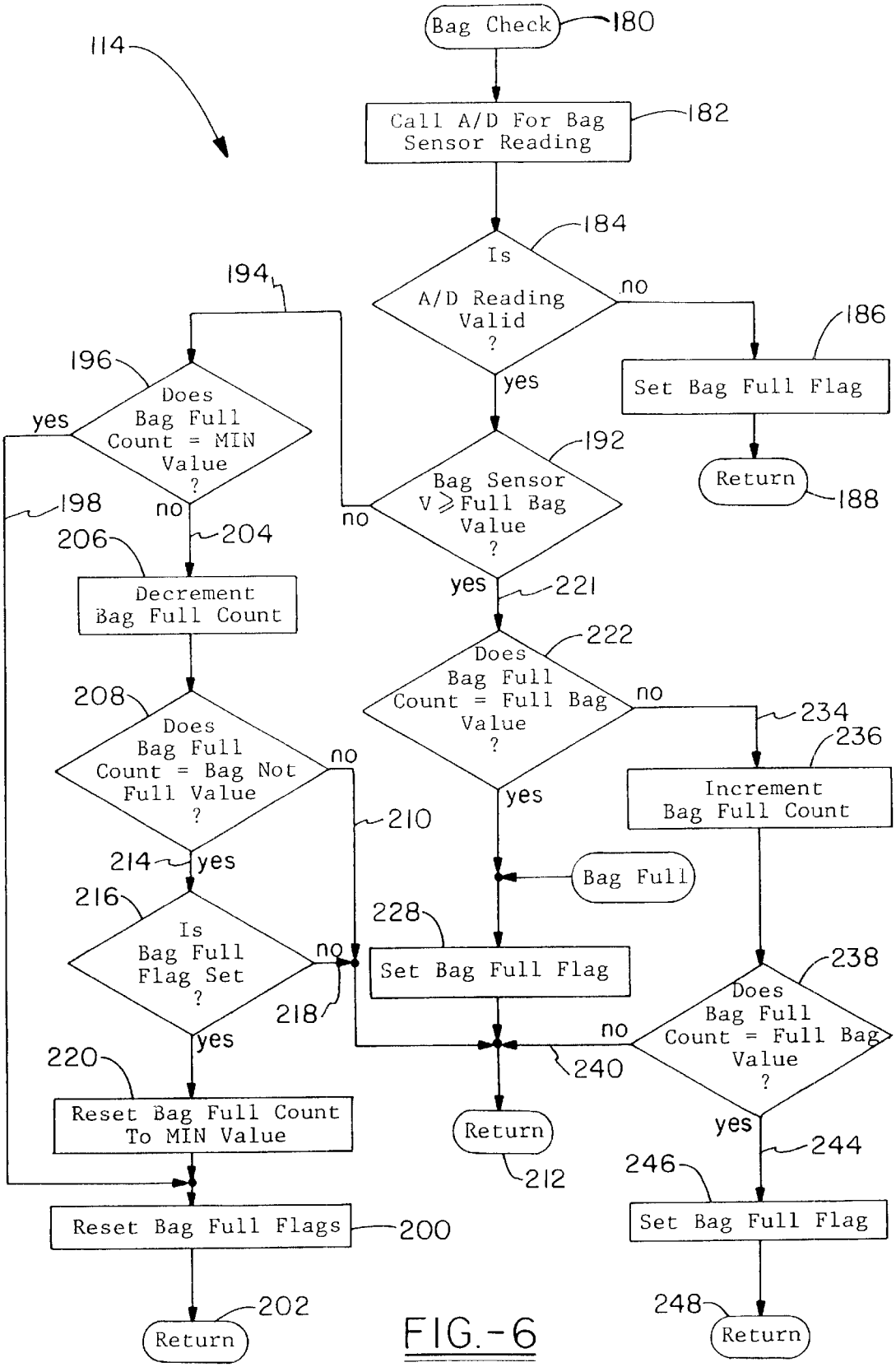
FIG. 6 is a flowchart of the processing routine employed by the microprocessor to check the fill level of the filter bag that collects the dirt.

Referring now to FIG. 6, the operational flow of the bag check subroutine 114 is presented. The process initially begins at step 180 to determine whether the filter bag 26 is full or nearly full, depending upon where the threshold value is set. A "bag full" counter is initially set to a minimum value such that there must be repeated full bag readings to set the bag full flag. If the threshold value is not met, then the bag full counter is decremented. In the event the bag full counter is equal to the bag not full value, then the bag full flag is reset.

The subroutine 114 first converts the analog signal 68 from the bag sensor 28 to a digital signal at step 182. The processor then determines whether the resulting signal from step 182 is valid at step 184. Accordingly, at step 184, if it is determined that the analog-to-digital reading is not valid, then the bag full flag is set at step 186 and the process is returned, at step 188, to the general operational flowchart. However, if at step 184, it is determined that the analog-to-digital reading is valid, the flow proceeds to step 192.

At step 192, the bag sensor value, as provided by the pressure transducer, is compared to a predetermined threshold value. If this value is not greater than or equal to the full bag threshold, then the flowchart proceeds along path 194 to a decision step 196. Step 196 determines whether the bag full counter is equal to a minimum value. If it is, then the flowchart proceeds along path 198 to a position in the flowchart that resets the bag full flag at step 200 and whereupon the flowchart returns to the general operational flowchart at step 202.

If at step 196, if it is determined that the bag full counter is not at minimum value, then the process proceeds along path 204 to step 206 wherein the bag full counter is decremented. Next, at step 208, the processor determines whether the bag full counter is equal to the bag not full value. If not, then the process flows along a path 210 and returns to the general operational flowchart at step 212. If, however, it is determined that the bag full count is equal to the bag not full value at step 208, the flowchart proceeds along path 214 to step 216 which determines whether the bag full flag has been set. If the bag full flag has not been set, then the flowchart at path 218 returns to the general operational flowchart at step 212. If, however, the bag full flag has been set, at step 220, the bag full counter is reset to a minimum value and the bag full flag, at step 200, is reset and the process is returned at step 202.

Returning to the decision step 192, if the bag sensor value is greater than or equal to the full bag threshold—that is, the pressure transducer detects that the bag is becoming full or is full—then the flowchart proceeds along path 221 to a decision step 222 to determine whether the bag full counter is equal to the full bag value. If the processor determines that this is correct, then the bag is full and the bag full flag is set at step 228. The flowchart then proceeds to the return step 212 which returns the process to the operational flow shown in FIG. 4.

Returning to step 222, if it is determined that the bag full count is not equal to the full bag, then the process continues along path 234 wherein the bag full counter is incremented at step 236. After the counter is incremented, it is determined at step 238 whether the bag full count is equal to the full bag value. If the bag full count is equal to the bag full value, then the flowchart proceeds along path 244 and the bag full flag is set at step 246 and then the flowchart 114 is returned to the general operational flow of the microprocessor at step 248. But, if the bag full counter is not at the full bag value, then the subroutine 114 proceeds along path 240 to return the microprocessor to the general operational flow of the device at step 212.

Figure 7B:
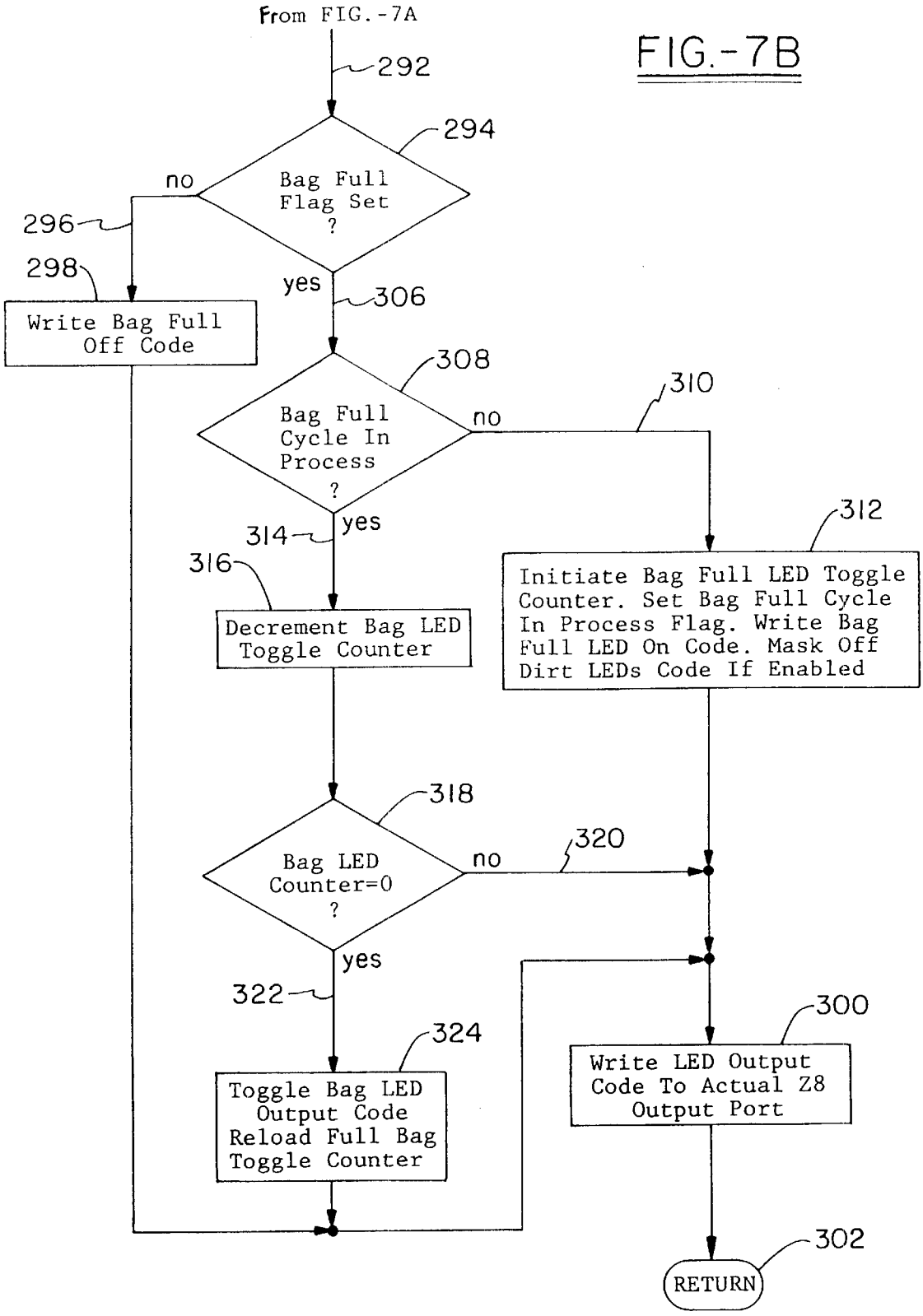

Referring now to FIGS. 7A and 7B, the output routine 120 of the operational flow is presented. The routine 120 begins with step 250 which toggles the bag/dirt sensor read flags to determine which output feature should be analyzed during the current cycle of operation. The flow chart proceeds to step 252 to determine whether the dirt present flag is set, wherein reference should be made to FIG. 5 to determine whether this has occurred or not. If it has not occurred, then the program 120 proceeds along path 254 to reset the "dirt cycle in process" flag at step 256. If, however, the "dirt present flag" is set at step 252, then the flowchart proceeds along path 260 to determine whether the "dirt cycle in process" flag has been set. If it has been set, then the flowchart proceeds along path 264. If the "dirt cycle in process" flag has not been set, then the flow chart proceeds along path 268 to step 270, whereupon the microprocessor initializes the dirt LED MIN on time counter, and the "dirt cycle in process" flag is set. The path 264 then converges with the output of step 270 such that at step 272 the microprocessor writes the green LED off and the red LED on codes. In other words, the processor automatically sets the illuminating lights to show that the microprocessor is detecting dirt.

At step 274, if it is determined that the LED MIN on counter is equal to 0, then the path proceeds, at step 286, to determine whether the dirt present flag has been set. If it has been set, then the LEDs remain in their current state—indicating that there is dirt present—and the process proceeds along path 288 to step 292. If, however, at step 286, it is determined that the dirt present flag has not been set, then the processor at step 290 writes the red LED off and the green LED on codes. In other words, since the dirt present flag has not been set, it is indicative that the sensor is not detecting the presence of dirt in the air duct and the green light is illuminated for benefit of the user.

Returning to step 274, if it is determined that the dirt LED on counter is not equal to 0, the program flows along path 276 wherein the counter is decremented at step 278. At step 280, the LED on counter is again checked and if it is equal to 0, then it proceeds along path 284 to step 286 as described above. If at step 280 it is determined that the dirt LED on counter is not equal to 0, then the process proceeds to step 292.

As best seen in FIG. 7B, the output flowchart determines whether the filter bag has reached its full or almost full level. Accordingly, from step 292, the microprocessor proceeds to step 294 to determine whether the bag full flag has been set. If it has not been set, then the flowchart proceeds along path 296 to write the bag full LED off code at step 298. This effectively turns off the amber LED so that it is not illuminated and provides an indication to the user that the bag is not full and that they can proceed with their cleaning.

If at step 294 it is determined that the bag full flag has been set, then the flow chart proceeds along path 306 to determine whether the bag full cycle is in process at step 308. If it is not in process, then the flowchart proceeds along path 310 to step 312 whereupon the microprocessor performs several functions such as: initiating the bag full LED toggle counter; setting the "bag full cycle in process" flag; writing the bag full LED on code; and masking off the dirt LEDs code if they are enabled. From step 312, the process proceeds to step 300, wherein the LED output codes are written to the microprocessor which functions to turn the yellow amber flag on to provide an indication to the user that the bag is full.

If at step 308, it is determined that the bag full cycle is in process, then the flow chart proceeds along path 314 to step 316 wherein the LED toggle counter is decremented. Next, at step 318, if the LED counter is not equal to 0, then the process proceeds along step 320 which follows the path to write the LED output code and proceed to the general operational flow. If, however, it is determined that at step 318, the bag LED counter is equal to 0, then the flowchart proceeds along path 322, and the LED output code for the bag is toggled at step 324. This reloads the full bag toggle counter. Accordingly, then the process proceeds to step 300 which writes the LED output code and returns the processor to the general output flow. It will be appreciated that the output generation requires the flowchart to have successive readings of the bag full counter being decremented to 0 in order to maintain the amber light illuminated and provide an indication to the user that the bag is full.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A vacuum cleaner having an operational status indicator arrangement, the vacuum cleaner having a motor fan assembly for generating an airstream originating at a suction nozzle for removing dirt particles from a surface, a dirt particle filtering and collecting arrangement, and at least one conduit fluidly connecting the motor fan assembly, the suction nozzle and the dirt filtering and collecting arrangement, the operational status indicator arrangement comprising:

at least one sensor for detecting an operational status of the vacuum cleaner;

a microprocessor for receiving an input signal from said at least one sensor, comparing said input signal over a plurality of pre-determined time intervals to a threshold value, wherein said microprocessor has a pair of counters with corresponding maximum and minimum values, with said first counter initially set to a maximum first counter value, and said second counter initially set to maximum second counter value, wherein said second counter is decremented each time said input signal exceeds said threshold value and a flag is set when said second counter reaches said minimum second counter value and said first counter is again set to said first counter maximum value when said second counter is decremented a successive number of times equal to the maximum second counter value; and at least one indicator carried by said vacuum cleaner for indicating an operational status of said vacuum cleaner;

wherein said at least one indicator indicates the operational status when said flag is set.

2. The vacuum cleaner having an operational status indicator arrangement of claim 1, wherein said first counter is decremeted each time said input signal is less than said threshold value and said flag is reset when said first counter reaches said first counter minimum value and said second counter is reset to a maximum second counter value when said first counter is decremented a successive number of times equal to the maximum first counter value.

3. The vacuum cleaner having an operational status indicator arrangement of claim 2, said at least one indicator comprises a pair of lights, each of said pair of lights having one or more states including at first state wherein said light is illuminated and a second state wherein said light is turned off, wherein when one of said pair of lights is illuminated the other of said pair of lights is turned off, wherein one of said pair of lights is illuminated for a minimum of a predetermined time interval when said flag is set and the other of said pair of lights is illuminated after said one of said pair of lights is turned off.

4. The vacuum cleaner having an operational status indicator arrangement of claim 2, wherein said first counter is reset to said maximum first counter value if said input signal exceeds said threshold value after said first counter has been decremented.

5. The vacuum cleaner having an operational status indicator arrangement of claim 1, wherein said second counter is reset to a maximum second counter value each time said first counter is decremented.

6. The vacuum cleaner having an operational status indicator arrangement of claim 1, wherein said at least one indicator indicates the operational status for a minimum predetermined time interval after said flag has been set.

7. The vacuum cleaner having an operational status indicator arrangement of claim 1, wherein said at least one conduit includes a tube coupled to said motor fan assembly and said dirt filtering and collecting arrangement is a bag coupled to said tube for filtering and collecting dirt from said airstream.

8. The vacuum cleaner having an operational status indicator arrangement of claim 1, wherein said at least one sensor is a microphone.

9. The vacuum cleaner having an operational status indicator arrangement of claim 8, wherein said microphone is coupled to said tube, said microphone detecting noise generated by dirt moving through said tube and generating said input signal.

10. The vacuum cleaner having an operational status indicator arrangement of claim 1, further comprising a sensitivity switch carried by said vacuum cleaner and connected to said microprocessor, said sensitivity switch having a plurality of positions corresponding to a desired amount of sensitivity related to the operational status of the vacuum cleaner and adjusting said threshold value to a threshold value corresponding to the position of said sensitivity switch.

11. The vacuum cleaner having an operational status indicator arrangement of claim 1, further comprising a sensitivity switch carried by said vacuum cleaner and connected to said microprocessor, said, sensitivity switch having a plurality of positions corresponding to a desired amount of sensitivity related to the operational status of the vacuum cleaner and assigning a maximum first counter value and maximum second counter value corresponding to the position of said sensitivity switch.

12. The vacuum cleaner having an operational status indicator arrangement of claim 1, wherein said at least one indicator comprises a pair of lights, one of said lights illuminating when said flag is set, otherwise the other of said lights is illuminated.

13. The vacuum cleaner having an operational status indicator arrangement of claim 1, wherein said second counter is reset to said maximum second counter value if said input signal is less than said threshold value after said second counter has been decremented.

14. The vacuum cleaner having an operational status indicator arrangement of claim 1, wherein said flag is a dirt present flag.

15. A vacuum cleaner having an operational status indicator system, the vacuum cleaner having a motor fan assembly for generating an airstream originating at a suction nozzle for removing dirt particles from a surface, a dirt particle filtering and collecting arrangement, and at least one conduit fluidly connecting the motor fan assembly, the suction nozzle and the dirt filtering and collecting arrangement, the operational status indicator system comprising:

at least one sensor for detecting an operational status of the vacuum cleaner;

a microprocessor for receiving an input signal from said at least one sensor, comparing said input signal over a plurality of pre-determined time intervals to a threshold value, wherein said microprocessor has a counter with corresponding maximum and minimum values, with said counter initially set to a minimum counter value, wherein said counter is incremented each time said input signal exceeds said threshold value and a flag is set when said counter reaches said maximum counter value; and at least one indicator carried by said vacuum cleaner for indicating an operational status of said vacuum cleaner;

wherein said at least one indicator indicates the operational status when said flag is set.

16. The vacuum cleaner having an operational status indicator system of claim 15, wherein said counter is decremented each time said input signal is less than said threshold value and said flag is reset when said counter has been decremented a number of times equal to the maximum counter value.

17. The vacuum cleaner having an operational status indicator system of claim 15, wherein said at least one conduit includes a tube coupled to said motor fan assembly and said dirt filtering and collecting arrangement is a bag coupled to said tube for filtering and collecting dirt from said airstream.

18. The vacuum cleaner having an operational status indicator system of claim 15, wherein said at least one sensor is a pressure transducer coupled to said bag, said pressure transducer detecting a pressure level in said bag and generating said input signal for comparison to said threshold value.

19. The vacuum cleaner having an operational status indicator system of claim 15, further comprising a sensitivity switch carried by said vacuum cleaner and connected to said microprocessor, said sensitivity switch having a plurality of positions corresponding to a desired amount of sensitivity related to the operational status of the vacuum cleaner and adjusting said threshold value to a threshold value corresponding to the position of said sensitivity switch.

20. The vacuum cleaner having an operational status indicator system of claim 15, further comprising a sensitivity switch carried by said vacuum cleaner and connected to said microprocessor, said sensitivity switch having a plurality of positions corresponding to a desired amount of sensitivity related to the operational status of the vacuum cleaner and assigning said maximum counter value corresponding to the position of said sensitivity switch.

21. The vacuum cleaner having an operational status indicator system of claim 15, said at least one indicator comprises a light having one or more states including a first state and a second state, the first state being illuminated and the second state being turned off, said light being illuminated when said flag is set and turned off when said flag is reset.

22. The vacuum cleaner having an operational status indicator of claim 15, wherein said flag is a bag full flag.

23. The vacuum cleaner having an operational status indicator system of claim 15, wherein the at least one sensor is positioned within an inlet to the motor fan assembly and monitors a pressure differential across said inlet.

24. A cleaner having an operational indicator system, comprising:

a suction nozzle;

a motor fan assembly for generating an airstream originating at the suction nozzle for removing dirt from a surface;

a conduit fluidly connected at one end to said motor fan assembly;

a bag fluidly connected to said conduit for collecting the dirt removed by said suction nozzle;

at least one sensor associated with said bag to monitor the amount of dirt therein, said at least one sensor generating an input signal;

a microprocessor for receiving at least one input signal from said at least one sensor, comparing said input signal to a threshold value, said microprocessor including a counter having a maximum value and a minimum value; and an indicator;

wherein said counter is initially set at said minimum value and incremented each time said at least one input signal exceeds said threshold value and said indicator indicates an operational status of said cleaner when said counter attains said maximum value.

25. The cleaner according to claim 24, wherein said counter is decremented each time said at least input signal is less than said threshold value and said indicator is turned off when said counter is decremented to said minimum value.

26. The cleaner according to claim 24, wherein the sensor is positioned within an inlet to the motor fan assembly and monitors a pressure differential across said inlet.

27. A floor care appliance having an operational status indicator system, the floor care appliance having a motor fan assembly for generating an airstream originating at a suction nozzle for removing dirt particles from a surface, a dirt particle filtering and collecting arrangement, and at least one conduit fluidly connecting the motor fan assembly, the suction nozzle and the dirt filtering and collecting arrangement, the operational status indicator system comprising:

at least one sensor for detecting an operational status of the vacuum cleaner;

a microprocessor for receiving at least one input signal from said at least one sensor, comparing said at least one input signal to a threshold value, wherein said microprocessor has at least one counter having a minimum and maximum counter value, wherein said at least one counter is decremented each time said at least one input signal exceeds said threshold value and a flag is set when said at least one counter reaches said minimum counter value; and at least one indicator carried by said floor care appliance for indicating an operational status of said floor care appliance;

wherein said at least one indicator indicates an operational status of said floor care appliance when said flag is set.

28. A floor care appliance having an operational status indicator system, the floor care appliance having a motor fan assembly for generating an airstream originating at a suction nozzle for removing dirt particles from a surface, a dirt particle filtering and collecting arrangement, and at least one conduit fluidly connecting the motor fan assembly, the suction nozzle and the dirt filtering and collecting arrangement, the operational status indicator system comprising:

at least one sensor for detecting an operational status of the vacuum cleaner;

a microprocessor for receiving at least one input signal from said at least one sensor, comparing said at least one input signal to a threshold value, and generating an output based upon the number of times said at least one input signal exceeds or falls below said threshold value; and at least one indicator carried by said floor care appliance for indicating an operational status of said floor care appliance;

wherein said at least one indicator indicates an operational status of said floor care appliance based upon said output signal.

29. A method of indicating the presence of dirt being picked up by a vacuum source, said method including the steps of:

creating an airflow with the vacuum source, said airflow travels through an airflow path;

providing a microphone within said air flow path, said microphone detects the presence of dirt within said air flow path and generates an AC audio signal;

converting said AC audio signal to a mean DC value using a diode pump circuit;

transmitting said mean DC value to a microprocessor;

comparing said mean DC value to a threshold level; and illuminating a visual indicator when said mean DC value exceeds said threshold level.

* * * * *